US005423709A

United States Patent [19]

Summers

[11] Patent Number: 5,423,709

[45] Date of Patent: Jun. 13, 1995

[54] COLLAPSIBLE DOLL HOUSE WITH FOLDABLE SECTIONS

[76] Inventor: Marie L. Summers, P.O. Box 36, High Bridge, N.J. 08829

[21] Appl. No.: 225,044

[22] Filed: Apr. 8, 1994

[51] Int. Cl.[6] ..... A63H 3/52

[52] U.S. Cl. ..... 446/478; 446/108; 446/109; 446/110

[58] Field of Search ..... 446/108–115, 446/476, 478, 487

[56] References Cited

U.S. PATENT DOCUMENTS

| | | | |
|---|---|---|---|
| 1,307,437 | 6/1919 | Curry | 273/286 |
| 1,386,423 | 8/1921 | Rapson | 446/478 |
| 1,428,405 | 9/1922 | Wegener | 446/478 |
| 1,569,066 | 1/1926 | Beiger | 446/108 |
| 1,845,254 | 2/1932 | Fancher | 446/110 |
| 1,867,374 | 7/1932 | Myers | 446/109 |
| 1,918,375 | 7/1933 | Bowesock et al. | 446/109 |
| 2,535,792 | 12/1950 | Goodale | 446/476 |
| 2,544,833 | 3/1951 | Hammond | 446/109 |
| 3,906,659 | 9/1975 | Walmer | 446/110 |
| 4,018,001 | 4/1977 | Walmer | 446/110 |
| 4,094,090 | 6/1978 | Walmer | 446/110 |
| 4,883,443 | 11/1989 | Chase | 446/478 |
| 4,964,249 | 10/1990 | Payne | 446/478 |
| 4,978,301 | 12/1990 | Dodge | 446/108 |
| 5,120,262 | 6/1992 | Caine | 446/476 |

FOREIGN PATENT DOCUMENTS

| | | | |
|---|---|---|---|
| 16927 | 10/1916 | United Kingdom | 446/478 |
| 111618 | 12/1917 | United Kingdom | 446/478 |
| 588518 | 3/1929 | United Kingdom | 446/478 |
| 596518 | 1/1948 | United Kingdom | 446/478 |
| 630676 | 10/1949 | United Kingdom | 446/111 |

OTHER PUBLICATIONS

"Hobby Builders Supply" catalog, pp. 6–9, and 80, Dec. 1992.

*Primary Examiner*—Robert A. Hafer
*Assistant Examiner*—Jeffrey D. Carlson
*Attorney, Agent, or Firm*—Kenneth P. Glynn; Gina M. Gualtieri

[57] ABSTRACT

This invention pertains to a foldable, collapsible doll house having a first foldable frame section, a second foldable section forming a partitioned attic, and a third foldable roof section. The three foldable sections are fastened together in such a manner as to provide a model doll house which is easily constructed or taken apart.

17 Claims, 5 Drawing Sheets

COLLAPSIBLE DOLL HOUSE WITH FOLDABLE SECTIONS

BACKGROUND OF THE INVENTION

1. Field of The Invention

This invention relates to a foldable, collapsible model doll house, capable of being easily constructed or taken apart. The design is unique in that it involves only three foldable sections to form the main house structure. It is extremely portable and can be conveniently stored to save space.

2. Information Disclosure Statement

Various types of doll houses have been developed to provide recreation and education to children and adults.

U.S. Pat. No. 1,845,254 to Fancher shows a collapsible playhouse made of a box-like frame which is held upright by a base and divided into compartments by a cross-shaped member, and cell members representing the various rooms in the house.

U.S. Pat. No. 1,867,374 to Myers teaches a toy house comprising numerous sections, some of which are folded and constructed to form the house.

U.S. Pat. Nos. 3,906,659; 4,018,001; and 4,094,090 describe various forms of a collapsible doll house, however, these doll houses are collapsible in the sense that each piece is not permanently secured to each other and can be completely disassembled.

U.S. Pat. No. 4,978,301 to Dodge teaches an educational construction set made of a fabric or plastic sheet, whereby all the pieces of the set assemble as separate pieces to form a house.

"Hobby Builders Supply" catalog, December, 1992 issue, displays a variety of doll house kits to be assembled piece by piece, however, these houses do not have foldable sections that are attached in a collapsible manner.

While the above cited prior art shows devices that are constructed to form a play house, none of these patents describe a foldable, collapsible doll house having three main foldable sections as with the structure of the present invention.

SUMMARY OF THE INVENTION

The device of the present invention provides a unique foldable, collapsible model doll house design comprising a first foldable section forming the frame of the house having a front panel, sides and an open back; a second foldable section forming a partitioned attic; and a third foldable section forming the roof of the model doll house with a flip-open roof rear portion. The three sections are fastened together in an upright position to provide the doll house of the present invention. The means for fastening should be something easily removable so as to allow for efficient assembly and dis-assembly, such as dowels which slide through holes or slots in the sides of the first foldable section, through holes in partitions of the second foldable sections, and through gable portions of the third foldable section. Various modifications can be included in the design of the present invention as herein described.

BRIEF SUMMARY OF THE DRAWINGS

The present invention described in the specification herein will be more fully understood when taken in conjunction with the drawings appended hereto, which show as follows.

DETAILED DESCRIPTION OF THE INVENTION

The device of the present invention provides a unique foldable, collapsible model doll house that is easily and quickly assembled and disassembled. It is, thus, compact and can be put away and stored after use to save space; and is extremely portable.

Figure 1:
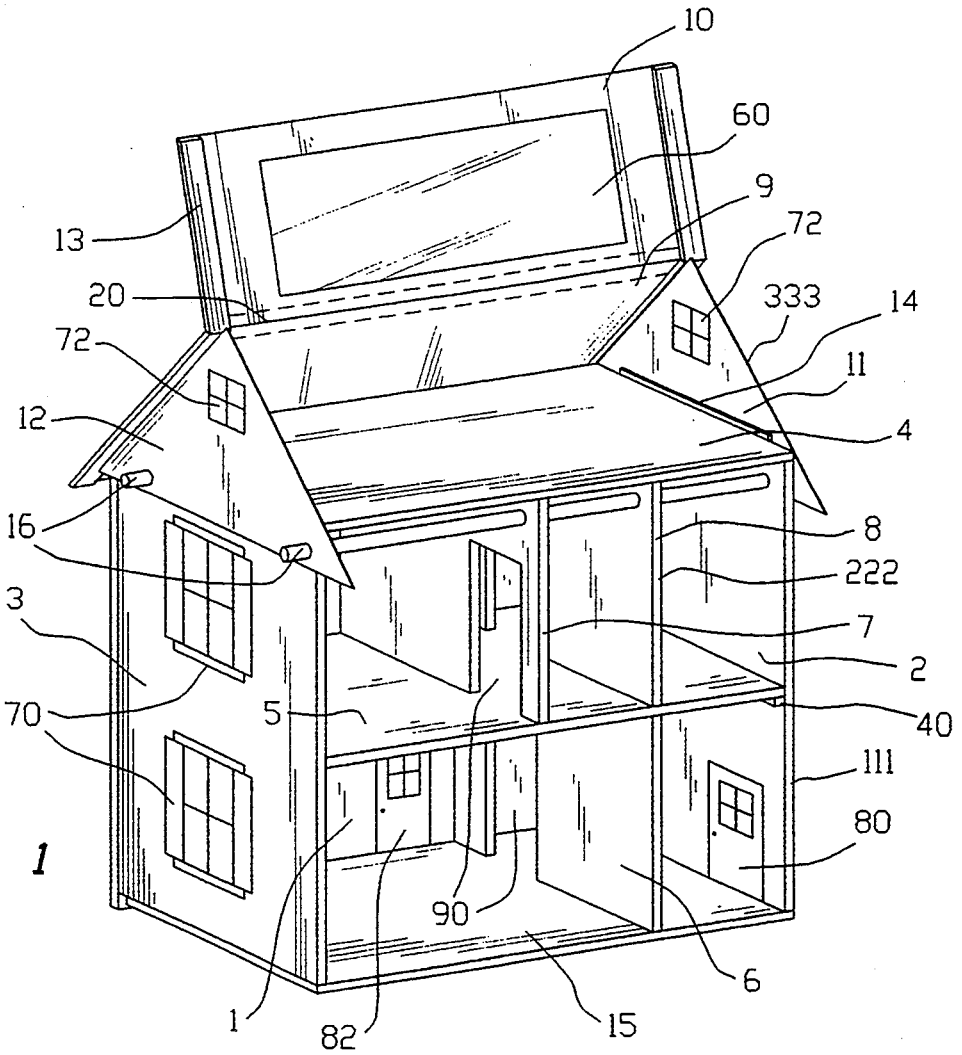
FIG. 1 shows a back view of the three unit doll house of the present invention.

The house comprises a first foldable frame section 111, a second foldable partitioned attic portion 222 and a third foldable roof section 333, the three sections being assembled to form an open-back doll house as illustrated in FIG. 1. The first foldable section 111 comprises a bottom panel 15, a front panel 1, a middle portion 5, a first partition portion 6, a first side wall 2 and a second side wall 3. The second foldable section 222 comprises second 7 and third 8 partition portions and an attic portion 4. The third foldable section 333 comprises a roof front portion 9, a roof rear portion 10, and first and second gable portions 11, 12.

Figure 2:
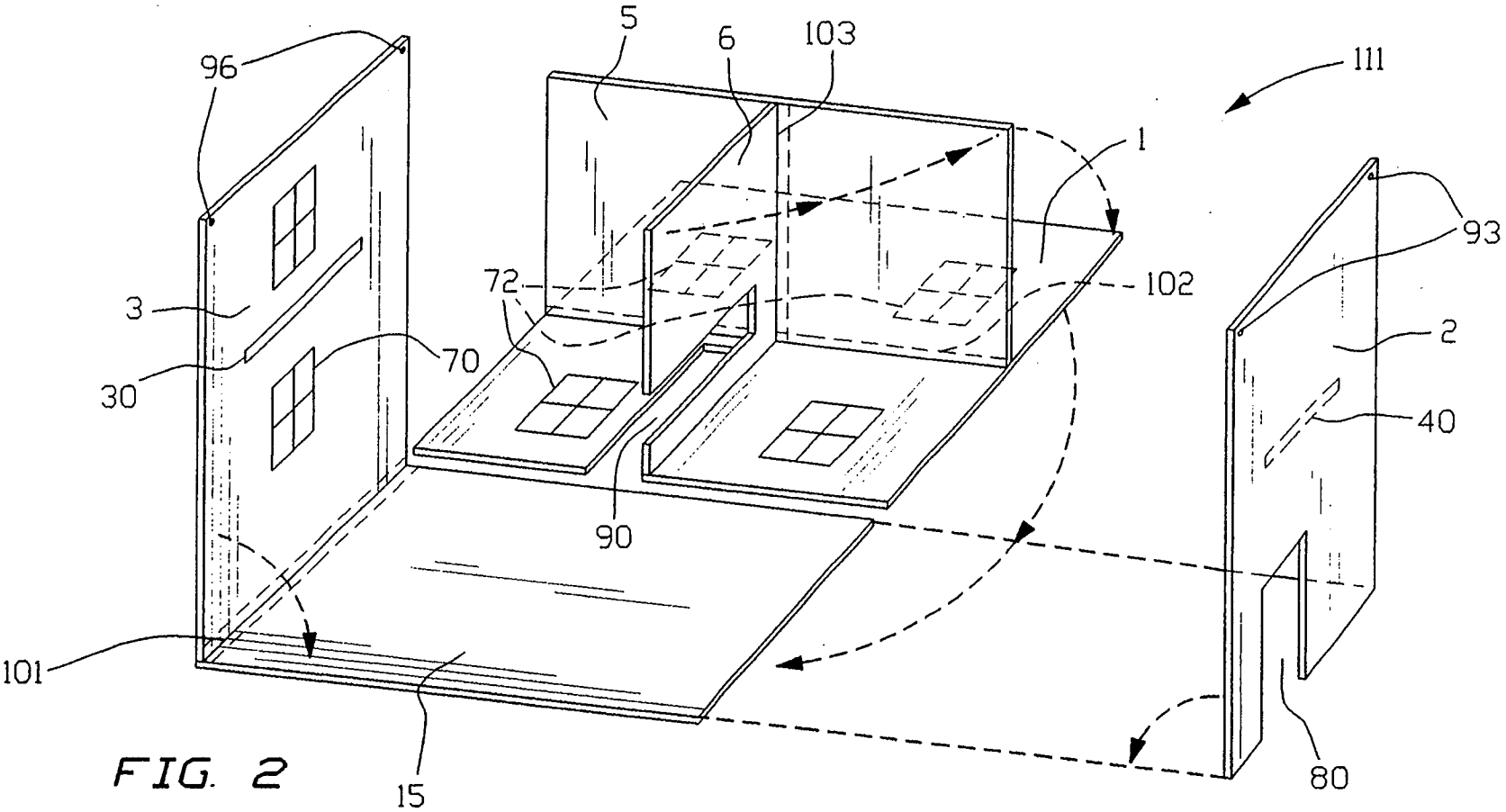
FIG. 2 shows a partial construction of the first foldable unit of the present invention.
Figure 3:
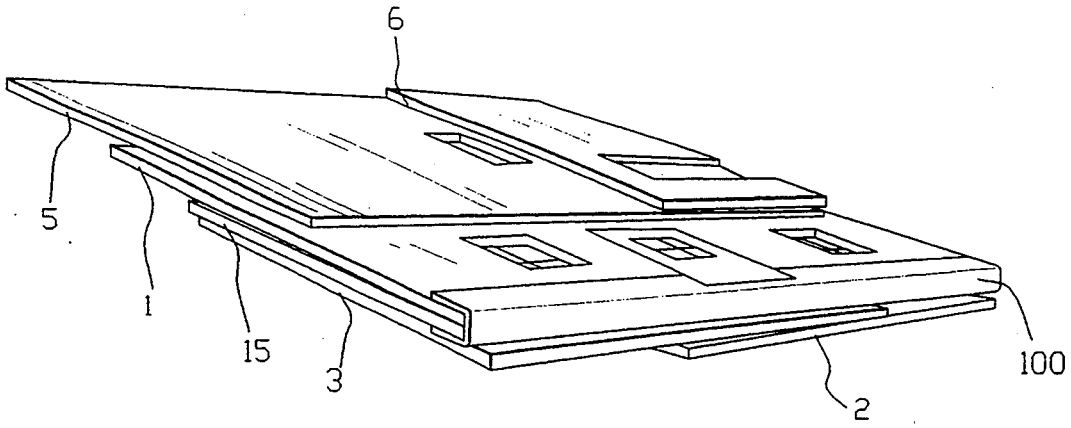
FIG. 3 shows the folded configuration of the first foldable unit of the present invention.

As illustrated in FIG. 2, indicated by fold arrows, and in FIG. 3, the components of the first foldable section 111 are fastened in such a manner as to allow for one foldable unit. Specifically, the bottom panel 15 and the front panel 1 are hingeably attached at 100, with the two side walls 2,3 then being attached in a foldable manner 101 to the bottom panel portion 15, such that a bottom edge of the first side wall is foldably connected to an inside surface of an edge of the bottom portion 15, and a bottom edge of the second side wall being foldably connected to an opposite edge of the bottom portion 15. In this way, the first and second side walls 2,3 contact respective side edges of the front portion 1 when unit one 111 is in an upright position. The middle portion 5 of unit one 111 is attached in a foldable manner 102 to a middle region of the inside surface of the front panel 1. The middle portion 5 acts as a divider which forms first and second floors, and provides means for the first partition portion 6 to attach (to the bottom surface of the middle portion 5) in a foldable manner 103 as shown in FIG. 2. This complete unit forms the first foldable section 111 folded as shown in FIG. 3.

Figure 4:
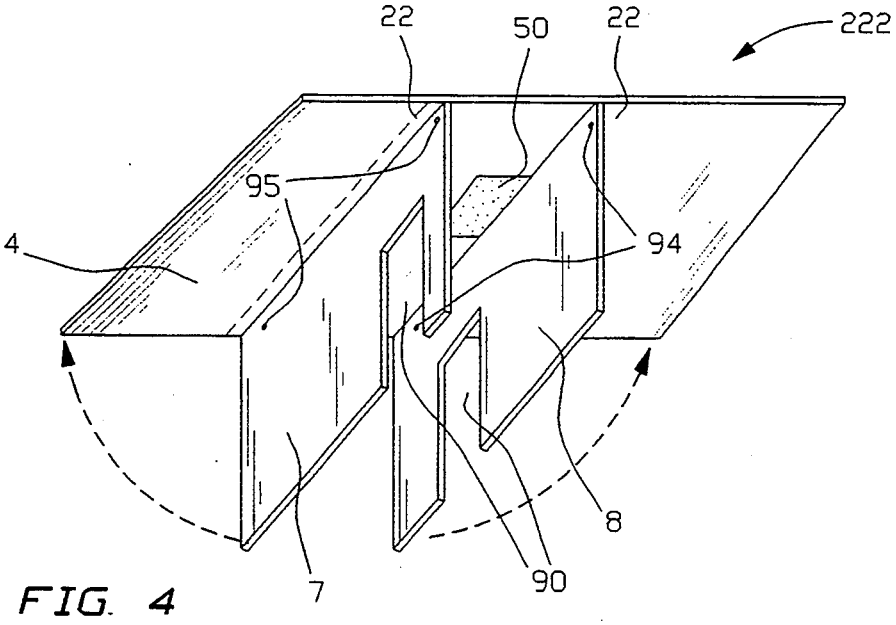
FIG. 4 shows an underside view of the assembled construction of the second foldable section of the present invention.

The second unit 222 forms the attic of the doll house and comprises second 7 and third 8 partition portions and an attic floor portion 4. The two partitions 7, 8 are foldably connected to a middle region of an underside of the attic portion 4 with hinges 22 as shown in FIG. 4, such that an outer surface of the second partition portion 7 lies on a first portion of the bottom surface of the attic portion 4 in a folded configuration and the outer surface of the third partition portion 8 lies on a second portion of the bottom surface of the attic portion 4 in a folded configuration. In addition, the attic portion 4 may comprise an open area 50 for the insertion of attic stairs (not shown).

Figure 5A:
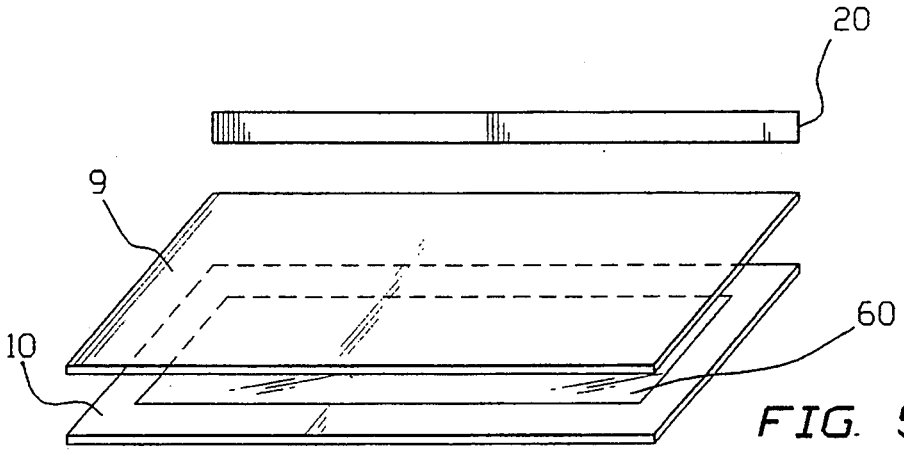
FIGS. 5*a* and 5*b* show a partial construction of the third foldable section, and the constructed model of the third foldable section of the present invention, respectively.
Figure 5B:
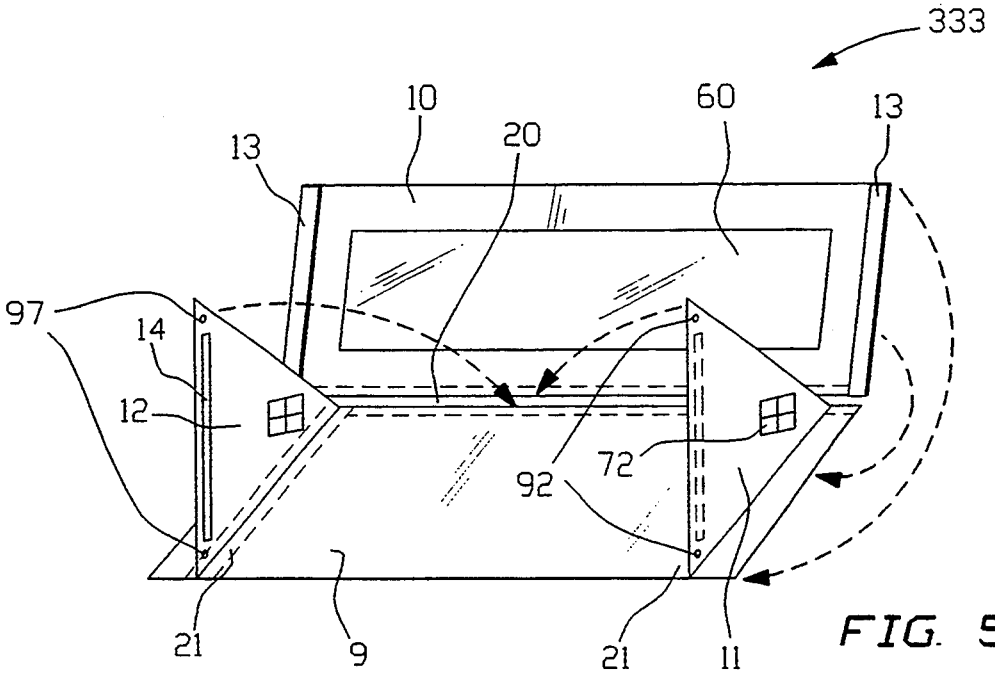

FIGS. 5*a* and 5*b* illustrate the third foldable unit which comprises a roof front portion 9, a roof rear portion 10, a first gable portion 11 and a second gable portion 12. As shown in FIG. 5*a*, the roof front 9 and roof rear 10 portions are first hingeably attached at 20. The first 11 and second 12 gable portions as shown in FIG. 5*b* are attached in a hinged manner with hinges 21 only to the roof front portion 9 to allow for a flip-open roof in the rear of the house. This attachment configuration allows one edge of each of the first and second gable portions 11, 12 to be foldably connected to an inside surface of respective edges of the roof front portion 9, such that the inside surfaces of the first and second gable portions 11, 12 lie on the inside surface of the roof front portion 9 in a folded configuration, and the inside surface of the roof rear portion 10 lies on the outside edges of the first and second gable portions 11, 12 in a folded configuration. In addition, gable stops 13, 14 are attached along the edges of the roof rear portion 10. The gable stops 13, 14 prevent the respective gables 12, 11 from sliding out by mating with the respective outer surface edge of each gable. The roof rear portion 10 further includes a window 60 such that when the roof rear portion 10 is closed, the inside of the doll house can be viewed. Fold lines with arrows are shown to indicate the fold pattern of the roof section in a folded configuration.

The doll house is formed when the three unit pieces 111, 222, 333 are assembled. Unit one 111 is folded as shown in FIG. 2 such that it is a standing, sturdy self-supporting structure. Unit two 222, in its constructed state, is then placed such that the two partition portions' bottom edges 7 and 8 rest on the middle floor portion 5 of unit one 111, with the edges (underside) of the middle floor portion 5 being supported by side wall rests 30 and 40 on respective side walls 2 and 3. Unit three 333 is then placed on top of units one 111 and two 222 so that the gable stops 14 of the first and second gable portions 11, 12 rest on the side edges of the attic floor portion 4 of unit two 222. The rear roof portion 10 of unit three 333 is then flipped over to cover the rear portion of the attic and secure the two gables with gable stops 13. Dowels 16 are then inserted in a parallel manner through drilled holes 92 in the first gable portion 11 of section three 333 which continues to pass through holes 93 in the first side wall 2 of section one 111, through holes 94, 95 in both the second and third partition portions 7, 8 of unit two 222, on through holes 96 in the second side wall 3 and through holes 97 in the second gable portion 12.

Figure 6A:
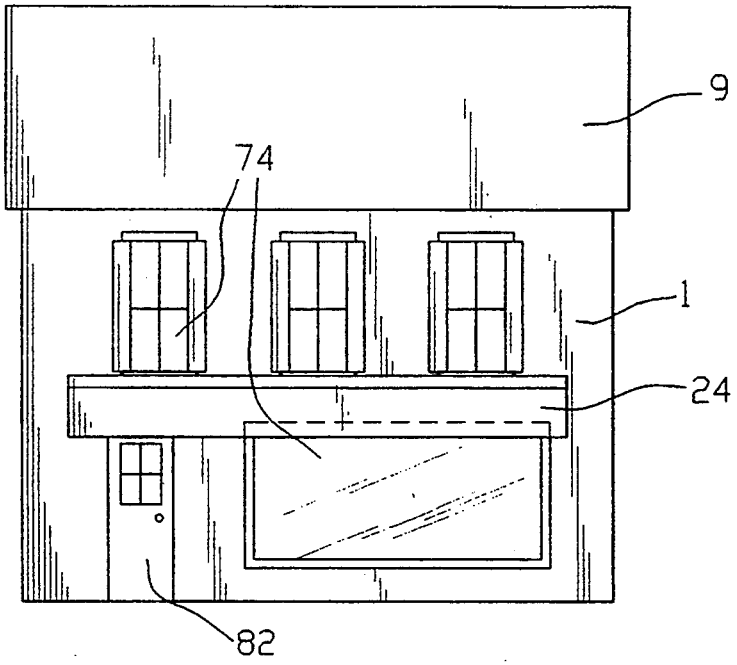
FIG. 6*a* shows a front view of the three unit doll house of the present invention.
Figure 6B:
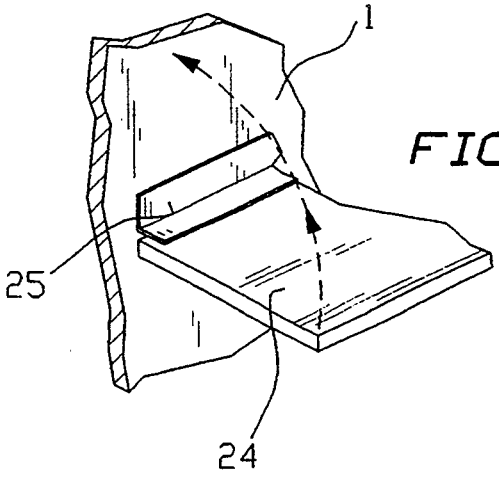
FIG. 6*b* shows an exploded view of a portion of the front panel of FIG. 6*a*.

FIG. 6*a* illustrates a view of one model of the front panel 1 including a plurality of windows 74 of varying sort, shape and size, at least one door 82, which may be attached by hinges as described herein, and an awning 24 over the window top border. As shown in FIG. 6*b*, the awning 24 is also attached by a hinge 25 which is fastened to the front panel 1.

The device of the present invention may also include such structures as windows in the side walls 70, gables 72, and roof rear portion 60; at least one door opening for doors in the side walls 80; and passage openings in the partition portions 90. In addition, the doll house may comprise aesthetic features such the decorative awnings 24 shown in FIG. 6*b*, or framework and shutters around the windows. Since the sections are foldable, the models including these features have been constructed in such a manner-sharp edges are sanded and slightly rounded, as to not impair the ability of the model to fold flat. The hinges 20–22, 25, 100–103 used throughout the doll house may be made of cloth fastened using glue, metal, plastic, or any combinations thereof. The dowels 16 are preferably wooden, but may be of plastic, or other such material.

Nails, screws and the like need not be used to keep the model together, and, further, no tools are necessary in its assembly.

Obviously, numerous modifications and variations of the present invention are possible in view of the above teachings. It is therefore understood that within the scope of the appended claims, the invention may be practiced otherwise than as specifically described herein.

What is claimed is:

1. A collapsible doll house, comprising:

(a) a first foldable section forming a frame of said doll house having a bottom panel foldably connected to a front panel, and first and second side walls foldably connected to said bottom panel thereby creating a self-supporting open back frame;

(b) a second foldable section forming a partitioned attic of said doll house;

(c) a third foldable section forming a roof of said doll house with a flip open roof rear portion; and, (d) fastening means for holding said first, second and third foldable sections together in an upright position, thereby forming a doll house, said fastening means being a combination of (i) openings in said first foldable section, said second foldable section and said third foldable section, and (ii) dowels, wherein individual dowels extend through all of said first foldable section, said second foldable section and said third foldable section.

2. The doll house of claim 1, wherein the dowels are wooden dowels.

3. The doll house of claim 1, wherein said third foldable section further comprises a roof front portion, a first gable portion and a second gable portion.

4. The doll house of claim 3, wherein said roof rear portion is foldably connected to said roof front portion by means of a hinge.

5. The doll house of claim 4, wherein the means for foldably connecting is a cloth hinge.

6. The doll house of claim 1, wherein the roof rear portion further comprises a window for viewing an attic of the doll house when the flip open roof is in a closed position.

7. A collapsible doll house, comprising:

(a) a first foldable section forming a frame of said doll house having a bottom panel, a front panel, first and second side walls and a middle portion; a front edge of said bottom panel being foldably connected to a bottom edge of said front panel, said first and second side walls being foldably connected to said bottom panel, and said middle portion being foldably connected to a middle portion of an inside surface of said front panel, thereby forming said first foldable section having an open back;

(b) a second foldable section forming a partitioned attic of said doll house, comprising a first and second partition portion and an attic portion, said partition portions being foldably connected to a middle region of a bottom surface of said attic portion, thereby forming a second foldable section;

(c) a third foldable section forming a roof of said doll house, said third section comprising a roof front portion foldably connected to a roof rear portion, and first and second gable portions; said first and second gable portions being foldably connected to respective edges of an inside surface of said roof front portion, thereby forming said third foldable section; said first, second and third foldable sections being collapsibly attached to form a collapsible doll house; and, (d) dowels and openings in said first, second and third foldable sections, wherein the dowels fit through openings in the first and second gable portions of the third foldable section, through openings in the second and third partition portions of the second foldable section, and through openings in the first and second side walls of the first foldable section, to hold the doll house in an upright position.

8. The doll house of claim 7, wherein said means for foldably connecting is hinges.

9. The doll house of claim 8, wherein the hinges are selected from the group consisting of cloth, metal, plastic and combinations thereof.

10. The doll house of claim 7, wherein said front panel, and at least one of said side walls further comprise respective door openings.

11. The doll house of claim 7, wherein at least one of said side walls, gables, roof rear portion and front panel comprises at least one window.

12. The doll house of claim 7, wherein said front panel further comprises a plurality of windows and an awning on an outside front surface thereof, said awning located over at least one of said plurality of windows.

13. The doll house of claim 7, wherein said middle portion of said first foldable section and said first partition portion and second partition portion of said second foldable section further comprise respective passage openings.

14. A collapsible doll house comprising:

(A) a first foldable section, said first foldable section comprising:

(a) a bottom panel portion having a front edge, a back edge, a first side edge, a second side edge, an inside surface and an outside surface;

(b) a front panel portion having an inside surface, an outside surface, a top edge, a bottom edge, a first side edge, and a second side edge, said bottom panel portion front edge being foldably connected to said front panel portion bottom edge;

(c) a middle portion having a front edge, a back edge, a first side edge, a second side edge, a top surface and a bottom surface;

(d) a first partition portion having a top edge, a bottom edge, a first side edge and a second side edge, said middle portion front edge being foldably connected to a middle region of said front portion inside surface and said first partition portion top edge being foldable connected to said bottom surface of said middle portion, and said first partition portion first side edge contacting said inside surface of said front portion;

(e) a first side wall and a second side wall, each of said side walls having an inside surface and an outside surface, a bottom edge, a top edge, a first side edge, a second side edge, and a side wall rest; said bottom edge of said first side wall being foldably connected to an inside surface of said first side edge of said bottom portion, and said bottom edge of said second side wall being foldably connected to an inside surface of said second side edge of said bottom portion, said respective first side edges of said first side wall and said second side wall contacting said inside surface of said front portion along said respective first and second side edges of said front portion, and a portion of each of said side edges of said bottom surface of said middle portion resting on said side wall rests of said first and second side wall;

(B) a second foldable portion, said second portion comprising:

(a) second and third partition portions, each of said partition portions having a top edge, a bottom edge, a first side edge, a second side edge, an inner surface and an outer surface, and;

(b) an attic floor portion having a front edge, a back edge, a first side edge, a second side edge, a top surface and a bottom surface, said top edges of said second and third partitions being foldably connected to middle region of said bottom surface of said attic floor portion, such that said outer surface of said second partition portion is adapted to lie on a first portion of said bottom surface of said attic floor portion in a folded configuration and said outer surface of said third partition portion lies on a second portion of said bottom surface of said attic floor portion in a folded configuration; and, (C) a third foldable portion, said third foldable portion comprising:

(a) a roof front portion having a top front edge, a bottom front edge, a first side edge, a second side edge, an inside surface and an outside surface;

(b) a roof rear portion having a top rear edge, a bottom rear edge, a first side edge, a second side edge, an inside surface and an outside surface, said top front edge of said roof front portion being foldably connected to said top rear edge of said roof rear portion;

(c) a first gable portion and a second gable portion, each of said gable portions having a base edge, a first edge, a second edge, an inside surface and an outside surface, said first edge of said first gable portion being foldably connected to an inside surface of said first side edge of said roof front portion and said first side edge of said second gable portion being foldably connected to an inside surface of said second side edge of said roof front portion, such that said first and second gable portions inside surfaces are adapted to lie on said inside surface of said roof front portion in a folded configuration and said inside surface of said roof rear portion is adapted to lie on said outside surfaces of said first and second gable portions in a folded configuration; said bottom edges of said second and third partition portions sitting on said top surface of said middle portion of said first foldable section; said third foldable section being collapsibly attached to said first foldable section such that said gable stops of said first and second gable portions of said third section support respective side edges of said attic floor portion of said second foldable portion, such that said third section forms a roof over said first section; and, (D) dowels and openings in said first, second and third foldable portions for collapsibly attaching said second and third partition portions, first and second gable portions and first and second side wall portions, wherein individual dowels extend through all of said first foldable section, said second foldable section and said third foldable section.

15. The doll house of claim 14, wherein the means for foldably connecting are hinges.

16. The doll house of claim 15, wherein said first, second and third partition portions each comprise respective passage openings.

17. The doll house of claim 15, wherein at least one of said side walls, said gables, said roof rear portion and said front panel further comprise at least one window.

* * * * *